US007445469B2

(12) United States Patent
Wu

(10) Patent No.: US 7,445,469 B2
(45) Date of Patent: Nov. 4, 2008

(54) ELECTRICAL CONNECTOR PROVIDING A BETTER COPLANARITY FOR TERMINAL SOLDERS

(75) Inventor: Zhe-Feng Wu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/012,083

(22) Filed: Jan. 31, 2008

(65) Prior Publication Data

US 2008/0182457 A1 Jul. 31, 2008

(51) Int. Cl.
*H01R 12/00* (2006.01)

(52) U.S. Cl. ..... 439/79

(58) Field of Classification Search ..... 439/79, 439/607

See application file for complete search history.

(56) References Cited

U.S. PATENT DOCUMENTS

| | | | | |
|---|---|---|---|---|
| 5,531,604 | A * | 7/1996 | Huang | 439/79 |
| 5,779,489 | A * | 7/1998 | Davis et al. | 439/79 |
| 6,475,000 | B1 * | 11/2002 | Hu et al. | 439/79 |
| 6,659,799 | B2 * | 12/2003 | Yang | 439/607 |
| 6,986,681 | B2 | 1/2006 | Tsai | |
| 2003/0104714 | A1 * | 6/2003 | Yeh | 439/79 |

* cited by examiner

*Primary Examiner*—Tho D Ta
(74) *Attorney, Agent, or Firm*—Wei Te Chung

(57) ABSTRACT

An electrical connector of the present invention includes an insulating housing (2) mounting a plurality of terminals (3) and a metallic shell (1) surrounding the insulating housing (2). The insulating housing (2) defines a plurality of terminal grooves (24) therein. A plurality of terminals (3) mounted on the insulating housing (2), each comprises a mating portion (312,322) received in the terminal groove (24) and a solder portion (315,325) extending out of the terminal groove. A terminal solder coplanarity means is provided at a rear portion of the housing.

16 Claims, 6 Drawing Sheets

ELECTRICAL CONNECTOR PROVIDING A BETTER COPLANARITY FOR TERMINAL SOLDERS

BACKGROUND OF THE INVENTION

1. Field of the Invention

The present invention relates to an electrical connector, and more particularly to a high definition multimedia interface (HDMI) connector providing a better coplanarity for terminal solders.

2. Description of the Prior Art

Nowadays, Liquid Crystal Displays (LCDs) have become the main choice as the output device for use in Audio/Video (AV) products. The increasing role of LCDs in AV products has created a need for connectors capable of transmitting digital signals between the LCDs and AV products. Therefore, a HDMI connector is provided as a transmission interface utilized for transmitting high definition multimedia digital signals, including high fidelity images and multi-channel audio signals.

U.S. Pat. No. 6,986,681 issued to Tsai on Jan. 17, 2006 discloses a HDMI connector comprising an insulating housing, a metallic shell and a plurality of terminals set in an upper row and a lower row. Each terminal comprises an elongated mating portion secured in a terminal groove defined on a terminal block which extends from a front surface of the insulating housing, and a solder portion bending downward from the mating portion and received in a positioning channel defined on a rear of the insulating housing. The positioning channel runs through a bottom wall of the insulating housing, therefore the solder portion of each terminal is in a hanging position and may stagger in a front-to-back direction, which is not advantage for keeping the coplanarity of the terminal solder portions when the connector is mounting onto a printed circuit board (PCB). More, as the terminal solder portions of the connector are under the bottom of the insulating housing, the whole connector will be disposed on one side of the PCG, which is not benefit for saving the space of the PCB. Hence, a new design which can overcome the problem is required.

SUMMARY OF THE INVENTION

Accordingly, an object of the present invention is to provide an electrical connector providing a better coplanarity for terminal solders.

In order to achieve the object set forth, an electrical connector comprises an insulating housing defining a plurality of terminal grooves therein; a metallic shell surrounding the insulating housing; and a plurality of terminals mounted on the insulating housing, each comprising a mating portion received in the terminal groove and a solder portion extending out of the terminal groove; wherein a terminal solder coplanarity means is provided at a rear surface of the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
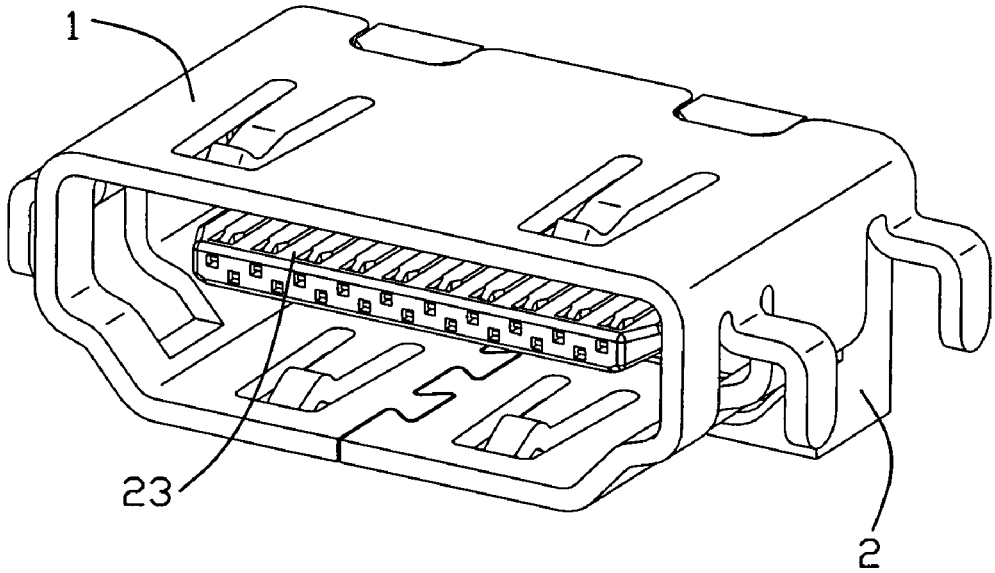
FIG. 1 is an assembled perspective view of an electrical connector in accordance with the present invention.

Reference will now be made to the drawing figures to describe a preferred embodiment of the present invention in detail.

Figure 2:
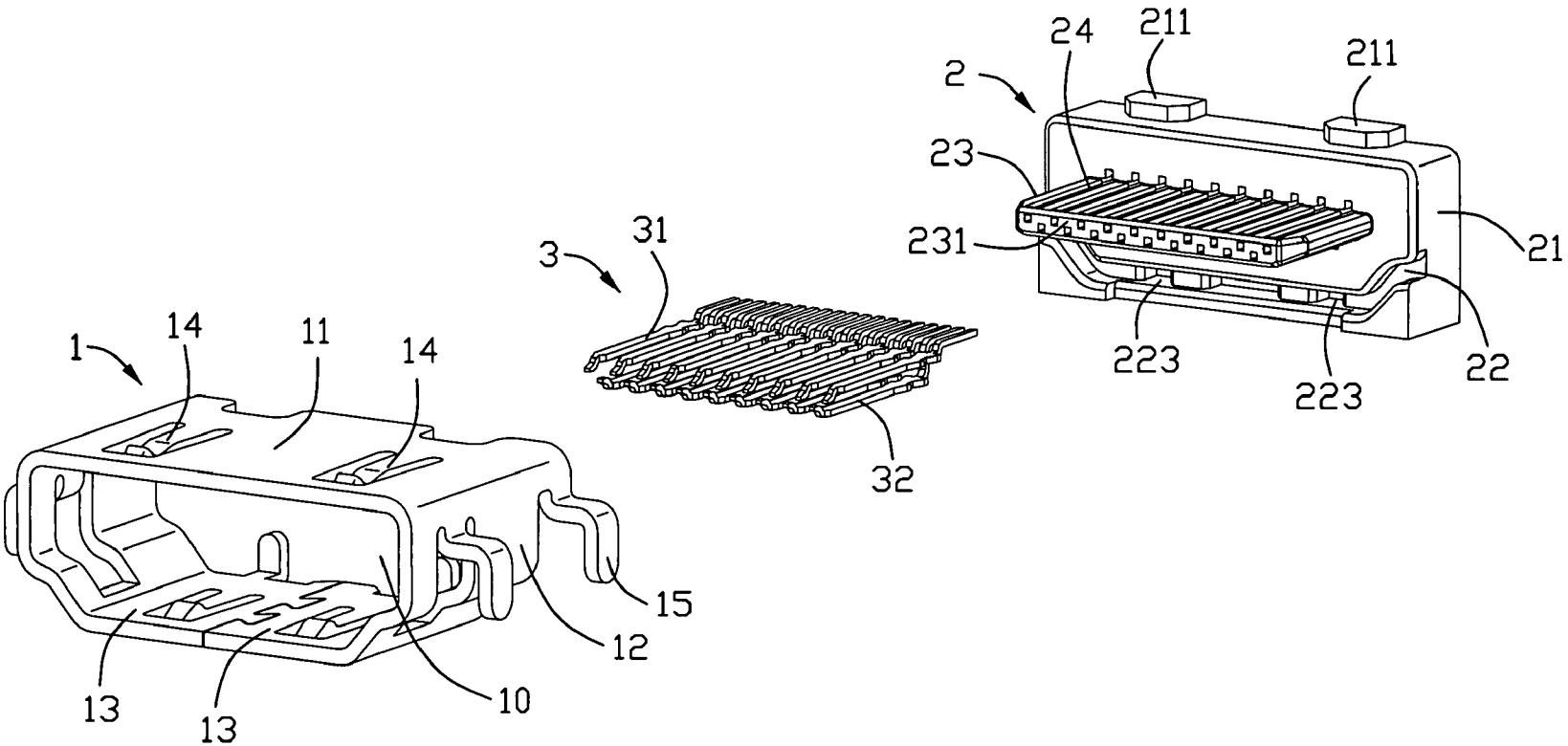
FIG. 2 is an exploded perspective view of the electrical connector shown in FIG. 1.

Referring to FIGS. 1 and 2, an electrical connector in accordance with the present invention comprises a metallic shell 1, an insulating housing 2 and a plurality of terminals 3.

Figure 3:
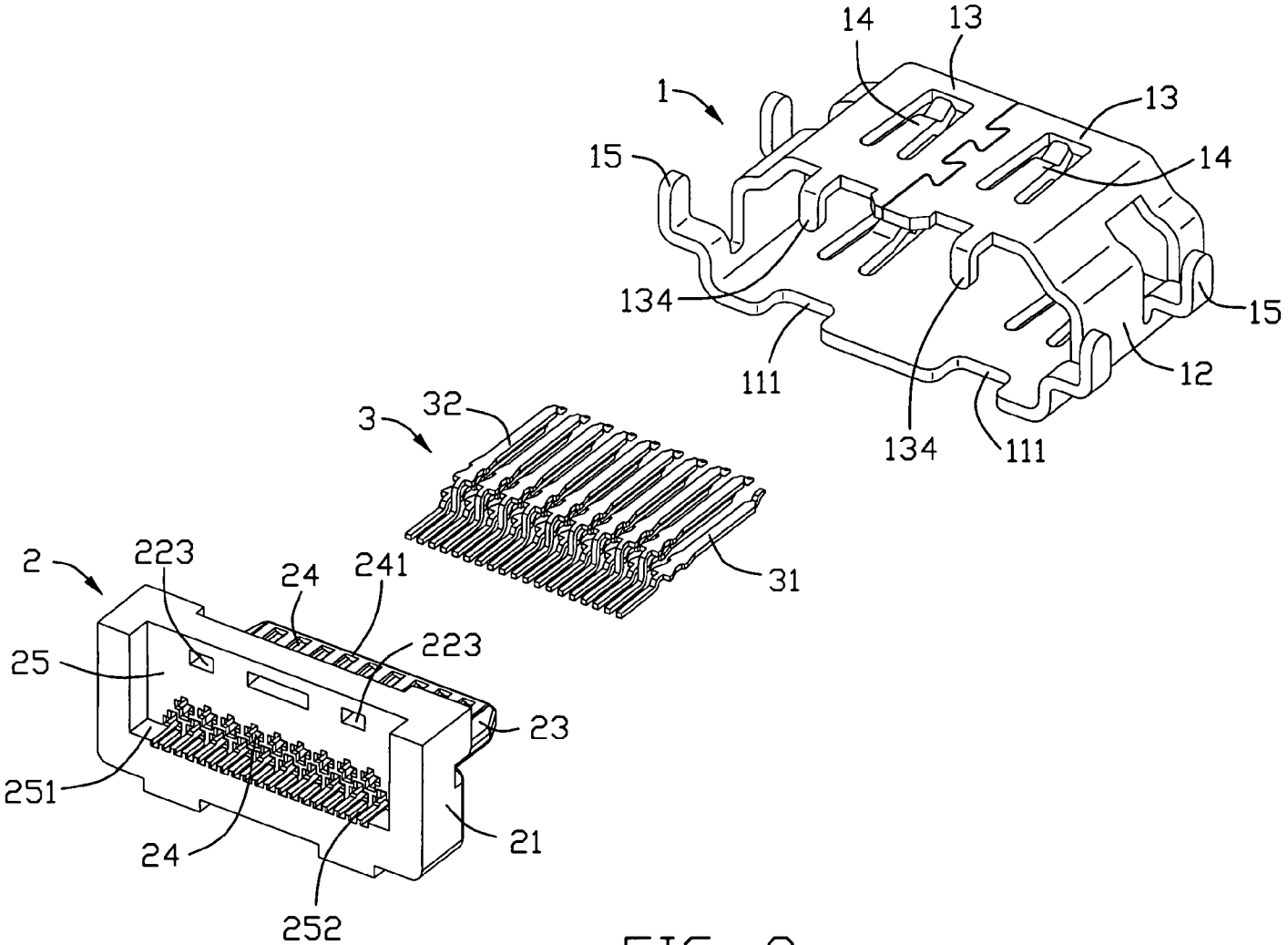
FIG. 3 is another exploded perspective view of the electrical connector shown in FIG. 1.

Referring to FIG. 2, the metallic shell 1 is made by bending a rectangular metal plate and forms a folded structure, defining a receiving space 10 therein. The shell 1 comprises an upper wall 11, a lower wall 13 parallel to and shorter than the upper wall 11 in a transverse direction, and two side walls 12 extending downward from the upper wall and bending inwardly at a lower portion thereof to connect with the lower wall 13. Two resilient sheets 14 are symmetrical formed at opposite ends of the upper wall 11 and lower wall 13 respectively and projecting to the receiving space 10 at each distal end. See FIG. 3, on a back end of the upper wall 11, a pair of slot 111 is opened rearward and a pair of solder tails 15 is formed at the transverse ends. A pair of solder tails 15 is also formed at the side walls projecting outward and bending downward. A pair of holding arms 134 is extending upward from a back end of the lower wall 13.

Referring to FIG. 2, the insulating housing 2 has a rectangular main body 21, a flat tongue plate 23 projecting from a front surface of the main body 21. A plurality of terminal grooves 24 arranged at intervals is respectively defined on an upper and a lower surface of the tongue plate 23. The terminal groove 24 runs through the tongue plate 23 and the main body 21 in a front-to-back direction and forms an opening at each distal end. At a bottom portion of the front surface of the main body 21, an irregular channel 22 is defined. On a top surface of the main body 21, a pair of protrusions 211 is projecting upward. See FIG. 3, a recess 25 is defined at a rear surface of the main body 21, which is recessing from a bottom wall of the main body 21 and terminating at a top portion of the rear surface above the openings of the terminal grooves 24. A plurality of positioning channels 252 arranged at intervals is defined on a roof 251 of the recess 25 along the front-to-back direction and parallel to the terminal grooves 24. Two through holes 223 are defined at a lower portion of the recess 25 and communicating with the irregular channel 22.

Figure 4:
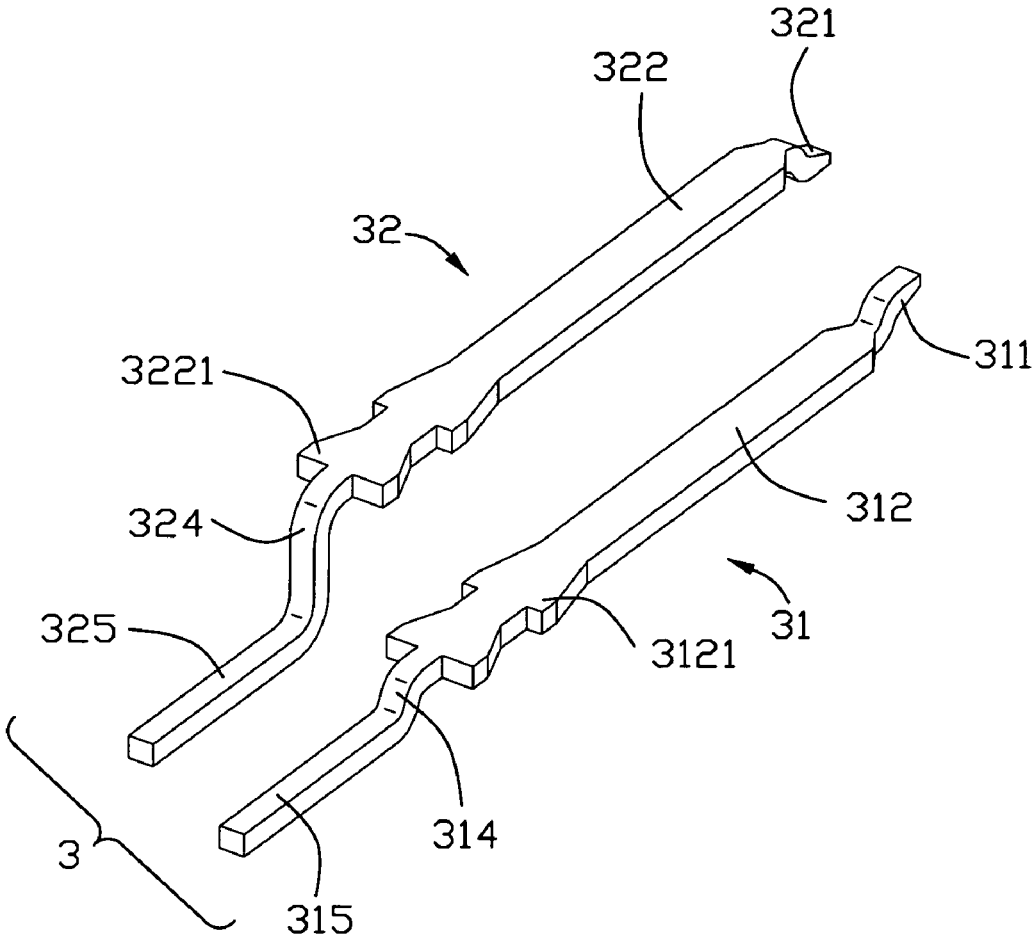
FIG. 4 is a perspective view of a pair of terminals of the electrical connector.
Figure 6:
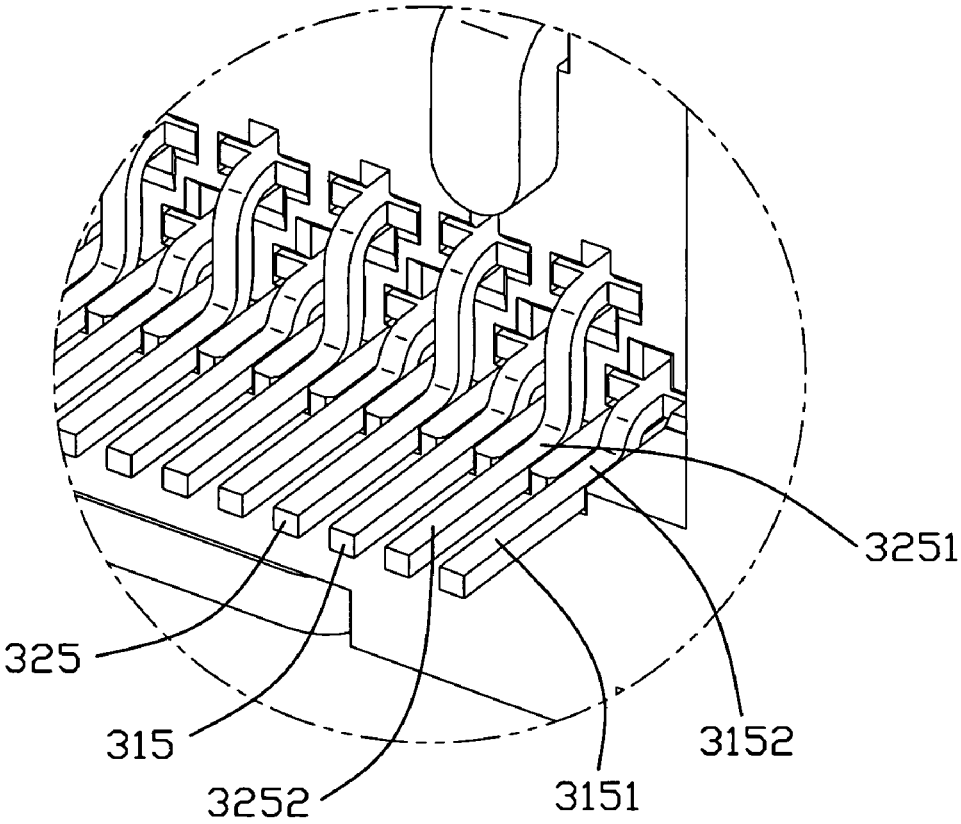
FIG. 6 is a partly-amplified perspective view of the electrical connector shown in FIG. 5.

Please look at FIGS. 2 and 4, the terminals 3 are arranged at two rows and respectively retained in the upper and lower terminal grooves 24. Each upper terminal 32 comprises an elongated mating portion 322 with a locking portion 321 projecting downward, a bending portion 324, and a solder portion 325 extending rearward from root of the bending portion 324 and parallel to the mating portion 322. See FIG. 6, each solder portion 325 comprises a first section 3251 connecting with the bending portion 324 and a second section 3252 extending forward from first section 3251 straightly. A plurality of tips 3221 is formed at both sides of the mating portion 322. The lower terminals 31 are similar to the upper terminals 32 and the only difference is that the locking portion 311 extends upward.

Figure 5:
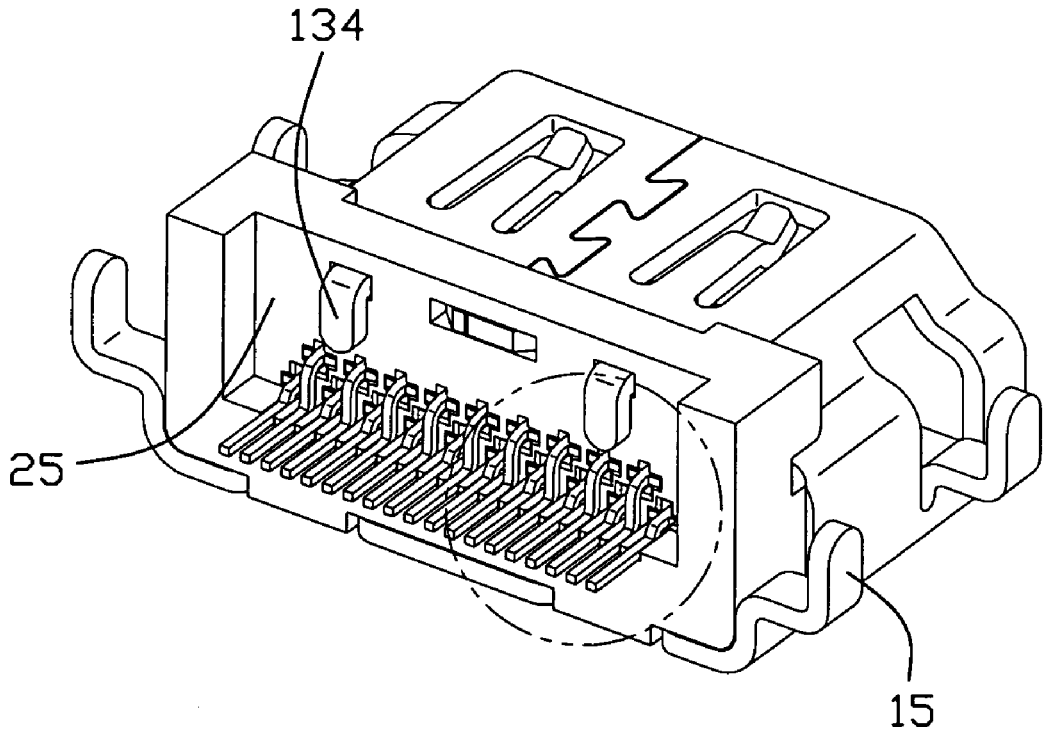
FIG. 5 is another assembled perspective view of the electrical connector shown in FIG. 1.

Please look at FIGS. 1 and 5, the terminals 3 are inserted into the terminal grooves 24 from the rear openings on the main body 21 until the locking portions 321 are fixed in the front openings on the tongue plate 23. The mating portions 32 are secured in the terminal grooves 24 and the tips 3221 are interfering with the inner side of the terminal grooves 24. The bending portions 324 are relied on the rear surface of the main body 21. As the bending portions 324 of the lower terminals 32 are longer than that of the upper terminals 31, the first section of the solder portions 315,325 are retained in the corresponding positioning channels 252 at a same level which can keep the solder portions 315, 325 of the terminals in a coplanarity position, and the second section of the solder portions 315, 325 are projecting outward for soldering on a PCB.

The insulating housing 2 with terminals 3 mounted thereon is inserted into the shell 1 from the rear end with tongue plate 23 projecting to the receiving space 10, the protrusion portions 211 are received in the slots 111 and the rear end of lower wall 13 is received in the irregular channel 22. The holding arms 134 are running through the through holes 223 and then bent downward, at this rate, the shell 1 is secured on the insulating housing 2, as shown in FIG. 5.

In this invention, the positioning channels 252 defined on the roof of the recess 25 provide an easy manner for maintain the solder portions 315,325 in a coplanarity position, which is helpful for soldering the connector onto the PCB. More, when the connector is mounted onto the PCB, the connector will be sinking in the PCB as the solder portions is set on the roof of the recess 25, which is benefit for saving the space of the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulating housing defining a plurality of terminal grooves therein;

a metallic shell surrounding the insulating housing; and a plurality of terminals mounted on the insulating housing, each comprising a mating portion received in the terminal groove and a solder portion extending out of the terminal groove;

wherein a terminal solder coplanarity means is provided at a rear portion of the housing;

wherein a plurality of positioning channels according to the terminal grooves are defined at a same level at the rear portion of the housing, the solder portions are partly received in the positioning channels so as to ensure the terminal solder portions in a coplanarity position;

wherein each of said positioning channels defines a downward supporting face against which a portion of the corresponding solder portion abuts;

wherein a retention portion of each of said terminals is vertically offset from the corresponding solder portion.

2. The electrical connector as claimed in claim 1, wherein the positioning channels and the terminal grooves are parallel to each other and defined at a different level on the housing.

3. The electrical connector as claimed in claim 1, wherein the positioning channels are facing a bottom portion of the housing.

4. The electrical connector as claimed in claim 1, wherein the insulating housing comprises a main body and a tongue plate extending forward from the main body with terminal grooves respectively defined on an upper and a lower surface, the terminals are arranged in two rows and respectively received in the terminal grooves.

5. The electrical connector as claimed in claim 4, wherein an irregular channel is defined on the front surface of the main body under the tongue plate, the shell is partly received in the irregular channel.

6. The electrical connector as claimed in claim 5, wherein the metallic shell comprises an upper wall, a lower wall shorter than the upper wall in a transverse direction, and two side walls connecting the upper wall and lower wall.

7. The electrical connector as claimed in claim 6, wherein the upper wall of the shell defines a pair of slots at the rear end and the insulation housing forms a pair of protrusion portions on top of the main body, the protrusion portions are received in the slot and a rear end of the lower wall is received in the irregular channel when the insulating housing is retained in the shell.

8. The electrical connector as claimed in claim 7, wherein the upper wall and the lower wall both define a pair of resilient sheets projecting inward.

9. An electrical connector comprising:

an insulative housing;

a plurality of contacts disposed in the housing with corresponding rear horizontal tail sections;

a platform formed on a rear face of the housing and defining a plurality of therein downwardly exposed slots extending along a front-to-back direction; wherein a front portion of each of said tail section is seated within the corresponding slot while a rear portion of each of said tail section is rearward exposed outside of said platform;

wherein each of said slot defines a downward supporting face against which the front portion of the corresponding tail section abuts;

wherein the rear portion of the tail section defines a downward soldering face which is configured for soldering on a printed circuit board;

wherein a retention portion of each of said contacts is vertically offset from the corresponding tail section.

10. The electrical connector as claimed in claim 9, wherein the front portion of the tail section is not soldered to a printed circuit board while the rear portion of the tail section is.

11. The electrical connector as claimed in claim 9, wherein said connector defines a solder plane, for soldering to a printed circuit board, located in a mid-level of said connector, and said printed circuit board defines a notch receiving said connector therein.

12. The electrical connector as claimed in claim 11, wherein each of said contacts defines a retention portion vertically offset from said tail section, and said retention portion and said printed circuit board are located on a same vertical side of said tail section.

13. The electrical connector as claimed in claim 9, wherein a vertical portion is located between the tail section and the retention portion in each corresponding contact.

14. The electrical connector as claimed in claim 13, wherein said vertical portion is exposed rearward to an exterior.

15. An electrical connector comprising:

an insulative housing; a plurality of contacts disposed in the housing with corresponding rear horizontal tail sections;

a platform formed on a rear face of the housing and defining a plurality of therein downwardly exposed slots extending along a front-to-back direction; wherein a front portion of each of said tail section is seated within the corresponding slot while a rear portion of each of said tail section is rearward exposed outside of said platform; wherein the slot confines the corresponding tail section in two opposite lateral directions and one vertical direction, while a printed circuit board, on which the connector is mounted, confines another vertical direction opposite to said vertical direction;

wherein a retention portion of each of said contacts is vertically offset from the corresponding tail section.

16. The electrical connector as claimed in claim 15, wherein the rear portion is soldered on the printed circuit board while the front portion is not.

* * * * *